United States Patent [19]

Bulso, Jr. et al.

[11] Patent Number: 4,873,859

[45] Date of Patent: Oct. 17, 1989

[54] APPARATUS FOR CONTROLLING MOVEMENT IN A SINGLE ACTION FORMING PRESS

[75] Inventors: Joseph D. Bulso, Jr., Canton; James A. McClung, North Canton, both of Ohio

[73] Assignee: Redicon Corporation, Canton, Ohio

[21] Appl. No.: 197,824

[22] Filed: May 23, 1988

Related U.S. Application Data

[63] Continuation of Ser. No. 12,625, Feb. 9, 1987, Pat. No. 4,796,454.

[51] Int. Cl.[4] ..... B21D 22/00

[52] U.S. Cl. ..... 72/336; 72/351

[58] Field of Search ..... 72/351, 350, 332, 333, 72/334, 335, 336, 329

[56] References Cited

U.S. PATENT DOCUMENTS

| | | | |
|---|---|---|---|
| 4,125,009 | 11/1978 | Byrd et al. | 72/350 |
| 4,206,701 | 6/1980 | Hemmelgarn | 100/257 |
| 4,207,048 | 6/1980 | Seymour | 425/151 |
| 4,249,410 | 2/1981 | Crago et al. | 72/347 |
| 4,375,785 | 3/1983 | Schoch et al. | 100/35 |
| 4,377,084 | 3/1983 | Kaminski | 72/325 |
| 4,489,584 | 12/1984 | Gall et al. | 72/327 |
| 4,549,424 | 10/1985 | Bulso, Jr. et al. | 72/329 |
| 4,587,826 | 5/1986 | Bulso, Jr. et al. | 72/329 |
| 4,624,125 | 11/1986 | Bulso, Jr. et al. | 72/453.13 |

*Primary Examiner*—David Jones

*Attorney, Agent, or Firm*—Reese Taylor

[57] ABSTRACT

A method of controlling the clamping movement of a single action drawing press having a fluid actuated pressure member wherein movement of the pressure member is interrupted by stops after a predetermined range of movement toward the base of the press. The apparatus for carrying out the method includes one or more stops, carried by the base, and dimensioned to engage the pressure member and overcome the pressure normally urging it toward the base after the predetermined range of movement.

3 Claims, 3 Drawing Sheets

APPARATUS FOR CONTROLLING MOVEMENT IN A SINGLE ACTION FORMING PRESS

RELATED APPLICATIONS

This Application is a continuation of Applicants' earlier filed Application Ser. No. 012,625, filed Feb. 9, 1987 and now U.S. Pat. No. 4,796,454.

FIELD OF THE INVENTION

This invention relates in general to the forming of material, such as metal, and relates in particular to the forming of such material in a single action press in which all of the tooling is carried by the single, movable slide of the press and wherein it is desirable to control holding pressure on the material during the forming operation.

DESCRIPTION OF THE PRIOR ART

It is well-known in forming thin pieces of metal or other material to draw a flat sheet by first blanking a disk or similar shaped workpiece followed by holding the peripheral edge of that piece and drawing the blank into the desired configuration.

One example of such a forming operation is the drawing of a cup to serve as a container or can. Another example of such a forming operation is involved in forming what are generally called "shells" which are the end pieces which are seamed onto the ends of two or three piece containers for beverages, foods or other products.

In forming material in this fashion and particularly when working with a single action press wherein all of the forming tooling is carried on the single, movable slide of the press, a problem is often encountered in pinching the peripheral edge which is held by part of the forming tooling during the drawing operation. The difficulty is particularly acute in instances in which the press "grows" as it heats up thereby making it necessary to either suffer with the pinching problem or to stop the production operation and readjust the shut height of the press so as to avoid excessive holding pressure on the edge.

This problem is often found in double action presses as well and Bulso U.S. Pat. No. 4,624,125 discloses one solution to the problem in that environment. There, apparatus is disclosed for retarding or limiting the movement of the forming punch or horn so as to control the "gap" and thereby the gripping pressure.

In a single action press, however, the pressure is "on" at all times and, therefore, since all of the tooling is carried by the single slide, it is not possible to attack the problem in that fashion.

Furthermore, the prior art has generally recognized the problem by providing stop blocks on the press structure itself to restrict the closing movement of the press. One difficulty is that this really does not fully compensate for the thermal expansion of the press during operation.

One example of this approach can be seen in Byrd U.S. Pat. No. 4,125,009 wherein the downward moving forming apparatus abuts a fixed spacer which thus fixes the gap between the forming member and the die. A further example of this approach is disclosed by the use of spacer bars in Crago U.S. Pat. No. 4,249,410.

Kaminski U.S. Pat. No. 4,377,084 discloses an attempt to avoid the problem which is thought to be encountered with the use of solid stop blocks by augmenting those blocks with resilient stop blocks which are positioned between the ram or slide and the bed of the press and which are compressed during downward movement. Seymour U.S. Pat. No. 4,207,048 also teaches the utilization of spacers which are clamped between the tool and the ram or between the tool and the press bed and employ a heat softenable plastic material to normally control the spacing, but also are capable of being heated and softened in the event there is a jam of the press.

Other approaches to solving spacing problems involve controlling the shut height by using a split ring arrangement on the press driving the tooling. Such an approach can be seen in Hemmelgarn U.S. Pat. No. 4,206,701.

Still a further approach is to attempt to obtain thermal stability in the press itself so as to control the shut height by using waste heat from the lubricant and circulating it through the drive assembly to heat the uprights to ensure equal thermal growth of the uprights and connections. Schoch U.S. Pat. No. 4,375,785 illustrates such a solution which is presumably operative, although requiring fairly complicated valving.

While all of these approaches are presumably effective for the purposes for which they are designed, it is believed that none of them really effectively provide for high speed, precisely controlled operation without stopping the press or bottoming it out on each cycle.

SUMMARY OF THE INVENTION

It is, therefore, an object of this invention to provide a means for controlling the space between a pressure member and the fixed base of a single action press notwithstanding thermal growth of the press components.

This object is accomplished by the provision of stop means carried by the base and interrupting travel of the pressure member after it has completed a predetermined travel toward the base.

This object is further accomplished by providing a cut edge carried by the movable slide of the press and having one or more through apertures therein whereby the stop means may project through the cut edge for engagement with the pressure member after the cut edge and pressure member have travelled together toward the base a predetermined distance.

Accordingly, production of a method and apparatus for controlling movement in a single action press of the character above-described becomes the principal object of this invention with other objects thereof becoming apparent upon a reading of the following brief specification considered and interpreted in view of the accompanying drawings.

OF THE DRAWINGS

BRIEF DESCRIPTION OF THE PREFERRED EMBODIMENTS

Figure 1:
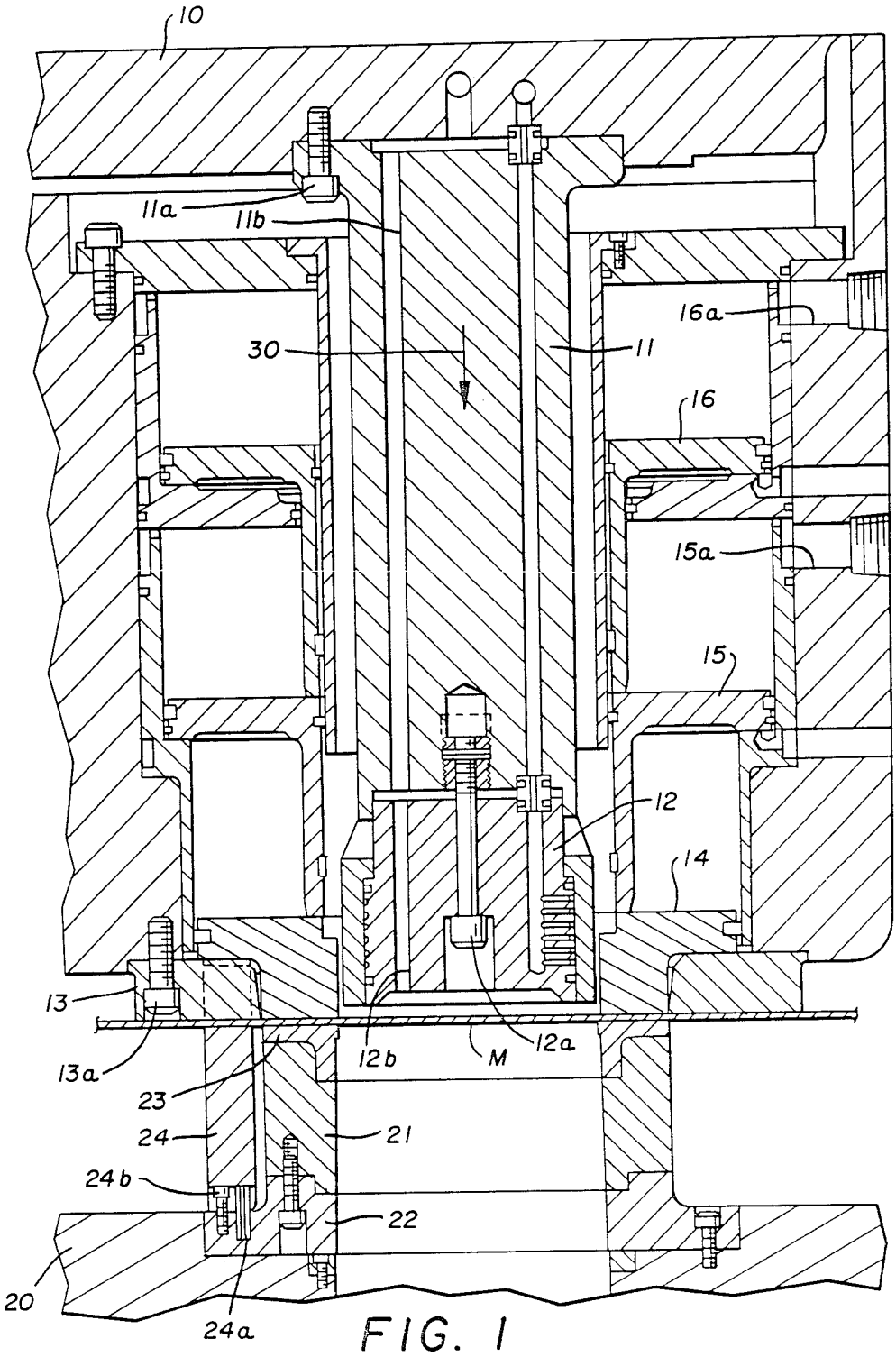
FIG. 1 is an elevational view, in section, showing the tooling necessary to carry out the method and of the invention with the tooling positioned just prior to blanking.

Referring first, then, to FIG. 1 o the drawings, it will be seen that the press itself is not illustrated in detail, since single acting presses are well-known in the art. Only sufficient portions of the press apparatus to enable one to understand the present invention have been illustrated.

With that in mind, it will be understood that the press includes a movable slide 10 and a fixed base 20 with the arrangement being that the slide 10 and any tooling carried thereon is movable toward and away from the fixed base 20 in a reciprocal fashion.

The movable slide 10 carries a draw horn riser 11 secured thereto by one or more screws 11*a* and extending therefrom toward base 20.

Secured to the distal end of the riser 11 is a suitable draw horn 12 which is attached thereto by screw 12*a*. It will also be noted here that the riser 11 has a through air passage 11*b* which communicates with a similar passage 12*b* in the horn 12 for assisting the removal of the finished product from the horn as will be described below.

Also carried by the movable slide 10 is a blank cut edge 13 which is secured thereto by suitable screws 13*a* and, therefore, moves with the slide 10 toward and away from base 20.

Between blank cut edge 13 and the draw horn 12 is disposed a draw pad or pressure member 14 which is movable with respect to the slide under fluid pressure which is supplied through passages 15*a* and 16*a* to pistons 15 and 16 which, in turn, act on the draw pad 14. When the slide 10 is pulling away from the fixed base 20, the draw pad 14 will, of course, be engaged by the top of blank cut edge 13 and carried away with it. When the slide is moving toward the base 20, the pad 14 would normally be urged toward the fixed base by pressure on the pistons 15 and 16.

Carried on the fixed base 20 is a blank and draw die 21 which is secured by a support ring 22. This blank and draw die 21 also includes a cut edge 23 which will cooperate with the blank cut edge 13 of the slide 10 to blank out the material from the sheet of stock M as it is fed into the press.

One or more stop members 24 are located by dowel pins 24*a* and secured by one or more screws 24*b* to the support ring 22. As can be seen from FIG. 4, in the form of the invention illustrated, four such stop members are employed and are disposed symmetrically about blank and draw die 21 so that the sheet of material M may pass through the press without interference therewith. These stop members will provide for control of the spacing of the components of the tooling, as will now be described.

Figure 4:
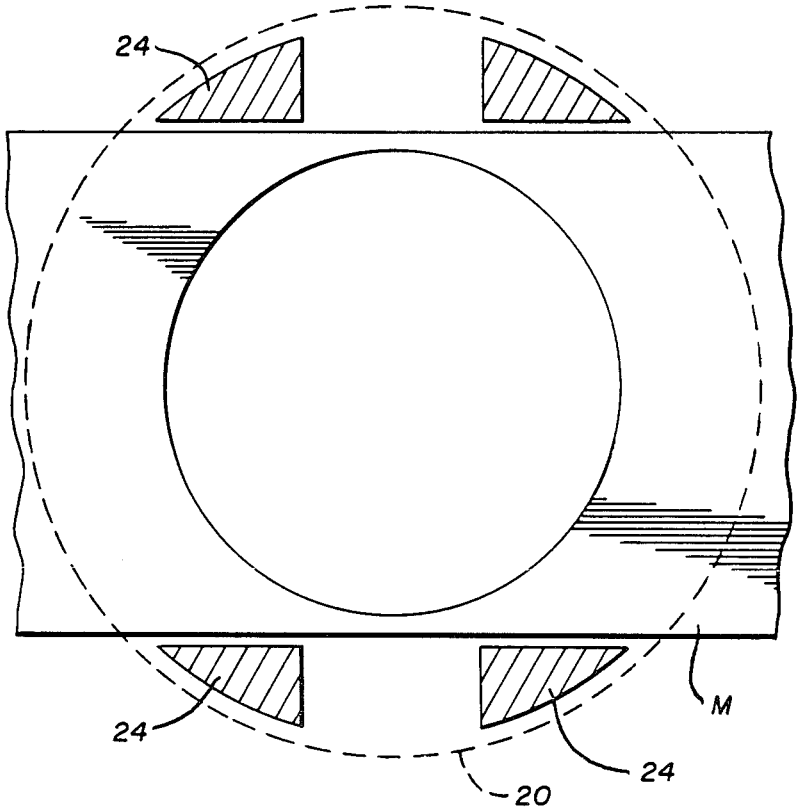
FIG. 4 is a plan view, showing the disposition of the stop means.

In use or operation of the tooling and referring to FIGS. 1 and 4, it will be assumed that the material M will be fed into the press from either a stack of sheets or from a coil. As noted, the spacing of the stop members 24,24 is such that this material M can pass through the press without interference therewith.

Additionally, the blank cut edge 13 has a series of suitably configured through apertures 13*b* therein which will enable the stop members 24 to project through the blank cut edge 13 to engage the draw pad 14, as will now be described.

Referring to FIG. 1, it will be noted that the slide 10 has been advanced toward the base 20 in the direction of arrow 30. In this condition, the draw horn 12 is just above the material M just prior to engaging it. The draw pad 14 has been forced down by pistons 15 and 16 and is in engagement with the top surface of the material with the bottom of the material being engaged by the cut edge 23.

It will be noted from FIG. 1 that at this point the draw pad 14 is spaced from the top of the stop member 24 a small distance. Ideally, this distance would be less than one-half the thickness of the material. In one typical application of the present invention to metal forming, the material would be 0.010 thick and the distance at this point between the top of the stop members and the bottom of the draw pad would be 0.002 or 0.003.

Figure 2:
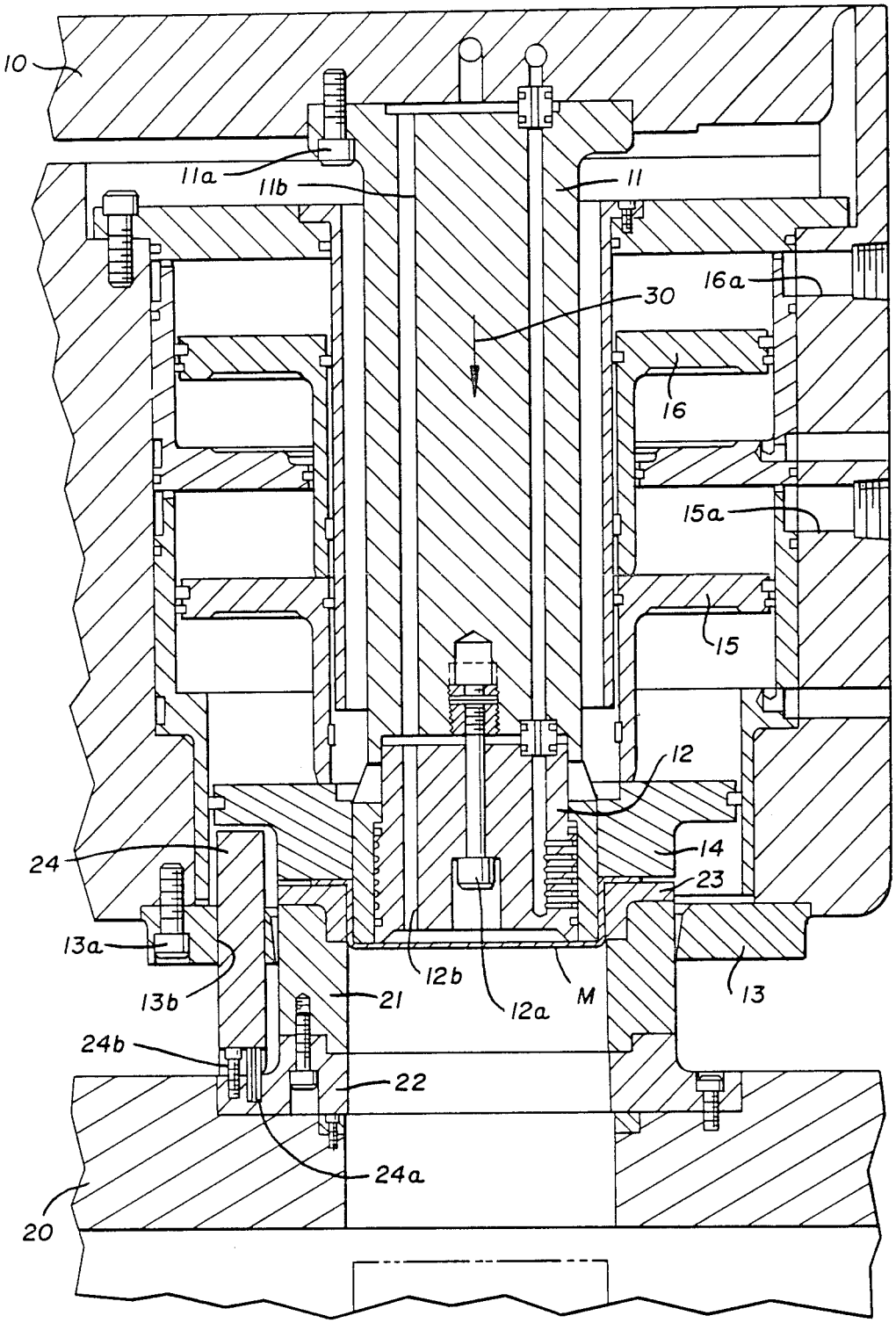
FIG. 2 is an elevational view, in section, showing the tooling at the beginning of the forming operation.

As the tooling is advanced by movement of slide 10 from the FIG. 1 position to the FIG. 2 position, the material will be blanked by blank cut edge 13 and cut edge 23.

Further downward movement of slide 10 advances blank cut edge 13 further toward base 20 with the stop members 24 projecting through apertures 13*b*. Also, draw horn 12 is advanced into blank and draw die 21 to partially form the material as clearly shown in FIG. 2.

During this movement, the flange or peripheral edge of the material is held between draw pad 14 and cut edge 23 with pressure being supplied to draw pad 14 by pistons 15 and 16. As the draw horn 12 advances, this flange is pulled toward the center of the die 21. If no means for stopping off holding pressure on draw pad 14 were provided, the flange would be pinched and thinned excessively.

However, since the draw pad can only travel about one-half or less the metal thickness after the tooling reaches the FIG. 1 position, this thinning can be controlled to satisfactory limits. Thus, it will be readily apparent that from the FIG. 1 position through the FIG. 3 position, the gap in which the flange is held between draw pad 14 and cut edge 23 can only decrease 0.002 to 0.003 in the example given.

Figure 3:
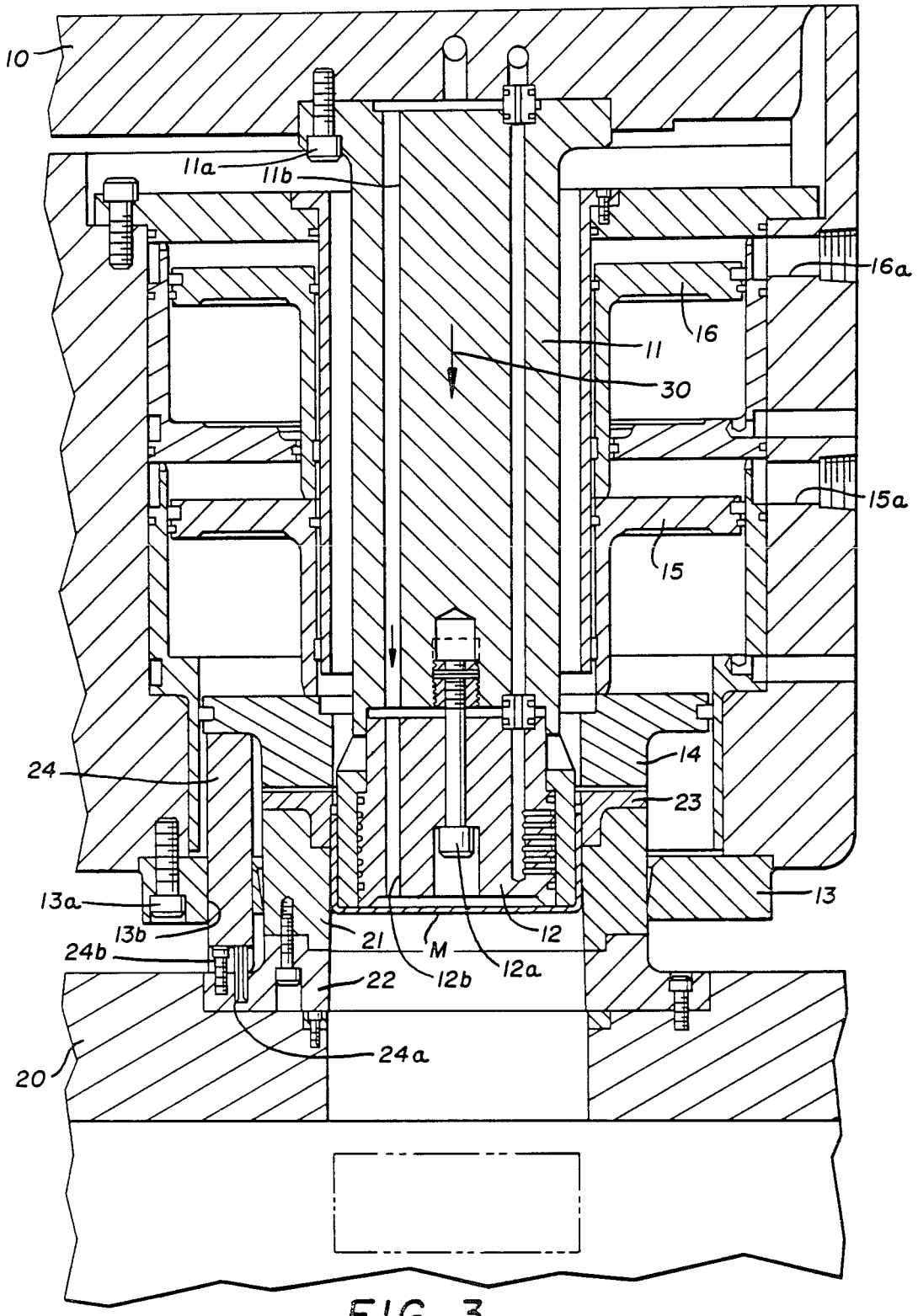
FIG. 3 is an elevational view, in section, showing the tooling at the end of the forming operation.

FIG. 3 shows the final forming operation wherein the material reaches its final configuration and, of course, application of air through the passages 11*b* and 12*a* will blow it off and pass it on through the die for removal from the press area.

During this operation, pressure has effectively been stopped off on the draw pad or pressure member 14. Since, in a single action press, the pressure on the pistons stays on throughout the cycle, pinching of the peripheral edge of the workpiece is thus avoided and thinning is controlled during the drawing operation.

While a full and complete description of the invention has been set forth in accordance with the dictates of the Patent Statutes, it should be understood that modifications can be resorted to without departing from the spirit hereof or the scope of the appended claims.

What is claimed is:

1. In a press for forming objects from a piece of material, said press having a movable slide and a fixed base, the improvement comprising:

(a) a draw horn secured to the slide for movement therewith toward and away from the base;

(b) a draw pad carried by the slide and movable toward the base and into engagement with the material under fluid pressure;

(c) a blank cut edge carried by the slide for movement therewith toward and away from the base;

(d) a blank and draw die carried by the base for cooperation with said cut edge and said draw horn; and (e) a plurality of stop members carried by and projecting from the base and dimensioned so as to directly engage the draw pad without engaging the material and arrest its movement toward the base after a predetermined amount of travel thereof and after engagement with the material by said draw pad and movement of said blank cut edge toward the base.

2. The press of claim 1 wherein said stop members are fixed to the base and extend therefrom toward the slide.

3. The press of claim 1 wherein said blank cut edge has through apertures therein; said stop members projecting therethrough to engage said draw pad.

* * * * *